US006274522B1

(12) United States Patent
Sameshima et al.

(10) Patent No.: US 6,274,522 B1
(45) Date of Patent: Aug. 14, 2001

(54) LIQUID ABSORBENT MATERIAL AND PROCESS FOR PREPARING THE SAME

(75) Inventors: Tadanori Sameshima; Teruo Miura; Kiyotaka Miyata; Eiji Yagura, all of Fuji (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 08/875,562

(22) PCT Filed: Sep. 6, 1996

(86) PCT No.: PCT/JP96/02545

§ 371 Date: Dec. 11, 1997

§ 102(e) Date: Dec. 11, 1997

(87) PCT Pub. No.: WO97/20090

PCT Pub. Date: Jun. 5, 1997

(30) Foreign Application Priority Data

Nov. 29, 1995 (JP) ..... 7-332513

(51) Int. Cl.[7] ..... D04H 1/06; D04H 13/02

(52) U.S. Cl. ..... 442/416; 442/333; 442/398; 442/415; 442/121; 162/146

(58) Field of Search ..... 442/333, 398, 442/415, 416, 127; 162/146

(56) References Cited

U.S. PATENT DOCUMENTS 4,141,460 2/1979 Stanistreet et al. ..... 220/88.2
5,284,704 * 2/1994 Kochesky et al. ..... 428/296
5,567,507 * 10/1996 Paff et al. ..... 428/213
5,629,069 * 5/1997 Hamajima et al. ..... 428/154
5,821,179 * 10/1998 Masaki et al. ..... 442/375
5,883,019 * 3/1999 Troung et al. ..... 442/166

FOREIGN PATENT DOCUMENTS 0286318 10/1988 (EP) .
6238452 8/1994 (JP) .

* cited by examiner

*Primary Examiner*—Elizabeth M. Cole
*Assistant Examiner*—John J. Guarriello
(74) *Attorney, Agent, or Firm*—Squire, Sanders & Dempsey LLP; David B. Abel

(57) ABSTRACT

Disclosed is a liquid absorbing body and a method of manufacturing the liquid absorbing body which has an excellent swelling property and absorbed liquid holding ability in a vertical state and which is suitable to a mass production at a low manufacturing cost. This liquid absorbing body includes natural cellulose fibers and/or synthetic fibers, a thermally fusible material and a thickening material. This liquid absorbing body is formed by defibering natural cellulose fibers and/or synthetic fibers, a thermally fusible material and a thickening material in air and mixing them to form a mat, heating thus formed mat at a temperature higher than a fusible point of the thermally fusible material and then fixing the thickening material in a web by compressing the mat with a press roller.

33 Claims, 2 Drawing Sheets

LIQUID ABSORBENT MATERIAL AND PROCESS FOR PREPARING THE SAME

TECHNICAL FIELD

The present invention relates to a liquid absorbing body and a method of manufacturing the liquid absorbing body.

BACKGROUND ART

In conventional liquid absorbing bodies, liquid absorbing fibers which are formed of natural cellulose fibers or synthetic fibers have been used. Further, in the case where a liquid absorbing body needs to have a fire resistant property, liquid absorbing fibers which are formed of fire resistant fibers have been used.

Such a liquid absorbing body which needs to have a fire resistant property is preferably used in ink jet printers. Specifically, in ink jet printers, printing is carried out by instantly heating printing ink to cause it to boil and then spraying such heated ink through a plurality of small holes provided in the printing unit. In such ink jet printers, a fire resistant liquid absorbing body is provided at the carriage return position of the printing unit in order to absorb waste ink adhering to the printing unit which is apt to become extremely hot.

In recent years, some of such ink jet printers have been made portable to improve the usefulness thereof. In this regard, in order for such portable printers to be made compact, the internal space thereof needs to be extremely small. Accordingly, such printers require small-size liquid absorbing bodies to absorb waste ink.

However, because conventional liquid absorbing bodies swell up when absorbing waste ink, the volume occupied by such a liquid absorbing body increases when it absorbs waste ink. Consequently, the increase in volume of the liquid absorbing body at the time of swelling must be taken into account when installing such a small-sized liquid absorbing body into the limited internal space of the printer. As a result, the absolute liquid absorption volume which can be absorbed by the liquid absorbing body becomes quite small.

Furthermore, there is a possibility that the waste ink that has been absorbed by the liquid absorbing body leaks out when such a compact printer is carried around. In particular, such a leakage is likely to occur when the conventional liquid absorbing body is placed in a vertically suspended condition. In order to solve this problem, it is necessary to improve the absorbed liquid holding ability in a vertical state. As methods for improving the absorbed liquid holding ability, the following two methods have been known in the prior art.

In the first means, a sheet from which a liquid absorbing body is formed is made to have a high density. However, because this means reduces the spaces among the fibers of the liquid absorbing body, the absolute liquid absorption volume thereof is also reduced.

In the second means, high absorptive fibers or high absorptive resin or the like is contained in the liquid absorbing body. However, because such high absorptive fibers and high absorptive resin are likely to swell up, the volume of the liquid absorbing body also increases when swelling occurs.

The present invention has been made in view of the problem as described above. Accordingly, it is an object of the present invention to provide a liquid absorbing body which has an excellent swelling ability and an excellent absorbed liquid holding ability in a vertical state and which is suitable for mass production and can be manufactured at a low cost, and a method of manufacturing such a liquid absorbing body.

DISCLOSURE OF THE INVENTION

In order to achieve the object, a liquid absorbing body according to the present invention comprises a dry-type mat-shaped absorbing body which is in the form of a web mainly formed from natural cellulose fibers and/or synthetic fibers; a thickening material interposed among at least parts of the mutual fibers; and a thermally fusible material for fixing the thickening material to the fibers.

According to the liquid absorbing body, when liquid enters into the spaces among the fibers of the liquid absorbing body, a viscosity of the liquid increases immediately due to the thickening material. Therefore, no liquid leaks out even if the liquid absorbing body that has absorbed liquid is suspended vertically. Further, since thus formed liquid absorbing body has an excellent swelling ability, a volume thereof hardly increases even after it has absorbed liquid.

The thickening material is fixed to the natural cellulose fibers and or synthetic fibers by means of the thermally fusible material. Therefore, as for the thickening material, various types of thickening material such as fiber type or powder type or the like can be used. Further, since the thickening material is fixed by means of the thermally fusible material, the fixed thickening material will not fall from the natural cellulose fibers and/or synthetic fibers.

In addition, since the natural cellulose fibers and/or synthetic resin are used as the liquid absorbing fibers, a raw material cost is inexpensive and therefore manufacturing cost thereof can be reduced.

In this way, according to the present invention, it is possible to obtain an excellent swelling ability by using such a thickening material. Therefore, since it is not necessary to take increase in a volume after absorbing liquid into account, a liquid absorbing body which has substantially the same size as a limited space defined for the absorbing body can be used.

Further, according to the present invention, it is possible to obtain an excellent absorbed liquid holding ability in a vertical state by using the thickening material. Therefore, even if it is applied to a portable type ink jet printer, any liquid which has been absorbed in the liquid absorbing body will not leak out during transportation.

Furthermore, according to the present invention, since the thickening material is fixed to support fibers by employing adhesiveness provided by the fusion of the thermally fusible material, it is not necessary to use a needle punch or the like for fixing the thickening material. In addition, since the liquid absorbing material can be manufactured in a series of manufacturing steps, it is suitable for mass production.

Furthermore, according to the present invention, since the thermally fusible material is used, it is possible to fix the thickening material and the fire resistant material to the support fibers simultaneously at the same manufacturing step.

Moreover, according to the present invention, since the thickening material can be fixed to inexpensive support fibers such as natural cellulose fibers or the like by means of the thermally fusible material, the manufacturing cost can be reduced.

The liquid absorbing body of the present invention comprises a dry-type mat-shaped absorbing body which is in the form of a web mainly formed from fire resistant fibers; a thickening material interposed among at least parts of the mutual fire resistant fibers; and a thermally fusible material for fixing the thickening material to the fire resistant fibers.

In the same manner as described above, this liquid absorbing body has an excellent absorbed liquid holding ability in a vertical state and an excellent swelling property. In addition, there is also an advantage that it exhibits an excellent fire resistant property since fire resistant fibers are used in the liquid absorbing body.

The liquid absorbing body of the present invention comprises a dry-type mat-shaped absorbing body which is in the form of a web mainly formed from natural cellulose fibers and/or synthetic resin fibers, a fire resistant material and a thickening material which are interposed among at least parts of the mutual fibers, and a thermally fusible material for fixing the fire resistant material and the thickening material to the fibers.

In this invention, the fire resistant material is fixed to the natural cellulose fibers and/or synthetic fibers by means of the thermally fusible material instead of the fire resistant fibers that are used in the invention described above. Since a raw material cost of the fire resistant material is inexpensive in comparison with the fire resistant fibers, the manufacturing cost of the liquid absorbing body can be reduced.

DETAILED DESCRIPTION OF THE PREFERRED EMBODIMENTS

An embodiment of a liquid absorbing body according to the present invention will now be described in detail. In this regard, FIG. 1 shows a cross-sectional view of the liquid absorbing body according to the present embodiment.

Figure 1:
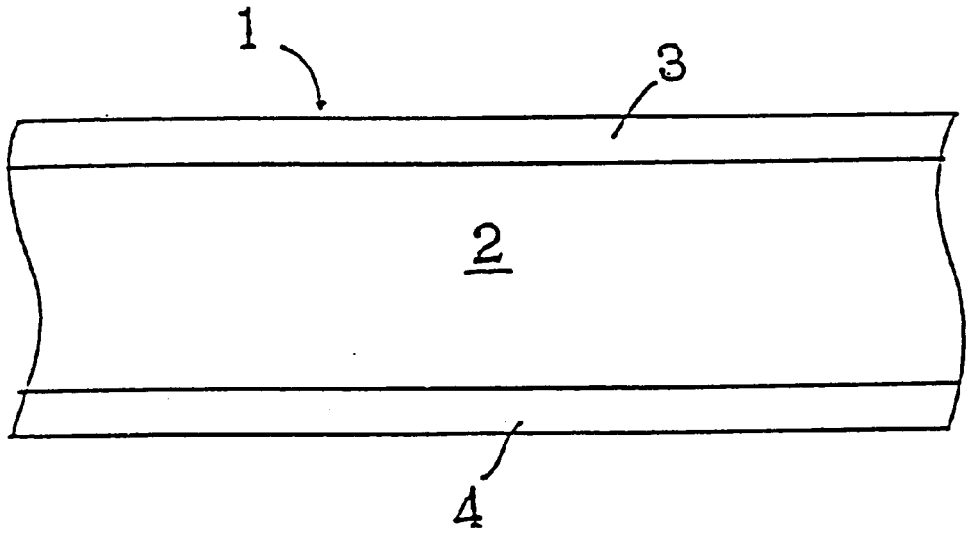
FIG. 1 is a cross-sectional view of a liquid absorbing body according to an embodiment of the present invention.

As shown in FIG. 1, a liquid absorbing body 1 according to the present embodiment is provided with an absorption layer 2 arranged between an upper surface sheet 3 and a bottom surface sheet 4. The absorption layer 2 is essentially constructed from a main support fiber, a thermally fusible material and a thickening material. This liquid absorbing body 1 is particularly suitable for absorbing waste ink in ink jet printers, but the use thereof is not limited to such ink jet printers.

It is possible to use any types of natural cellulose fibers or synthetic fibers for the main support fiber. Examples of such fibers include wood pulp, linters and other various non-wooden plant fibers and the like.

Examples of the thermally fusible material include thermally fusible fibers and thermally fusible powder. In this case, it is also possible to use a mixture of thermally fusible fibers and thermally fusible powder. Further, such a thermally fusible material is preferably formed of at least one resin selected from the group consisting of polyethylene, ethylene vinyl acetate, polyamide copolymer and polyester copolymer. Further, it is preferred that the thermally fusible powder has a particle size of 70 mesh pass (per inch). If the particle size is greater than this size, the number of bonding points will be reduced when the same volume of such a resin is mixed, so that effectiveness based on the use of the thermally fusible powder will be reduced. On the other hand, if the particle size is smaller than this size, such particles pass through the bottom sheet and a mesh conveyor at the time when various raw materials are difibered and mixed to form a web, and therefore they are not fixed among the fibers.

The thermally fusible fiber may be formed from a composite fiber constructed by covering a core portion of polypropylene fiber (melting point: 160° C.) with a covering layer of polyethylene (melting point: 130° C.). In the case where such a composite fiber is used, it is heated at a temperature which will melt the outer covering layer without melting the core portion. For example, heated air at a temperature of 140° C. is applied to melt only the outer covering layer. In this case, because the core portion does not melt, it is left as a stable fiber, and this makes it possible to obtain a strong non-woven fabric.

Further, it is preferred that the thermally fusible fiber and the thermally fusible composite fiber described above be fire resistant in order to improve the fire resistant property of the liquid absorbing body. One suitable example of such a fire-resistant thermally fusible composite fiber is an olefin-based fire resistant thermally fusible composite fiber manufactured by CHISSO Corporation under the product code "ESG 3 Denier" (Length: 5 mm).

As for the fire resistant material used in the present invention, it is possible to use various known fire-resistant materials. For example, powdered boric acid and borax are preferable since they are safety substance and commercially available with a low cost. Further, as other suitable fire-resistant material, it is also possible to use polyacrylic sodium cross-linking material which is commercially sold as high water absorbing resins having high hydration characteristics. Examples of a powder type of such a material which is commercially available include "AQUALIC" (product name of Nippon Shokubai Co., Ltd.), "DIAWET" (product name of Mitsubishi Chemical Corporation), "ARONZAP" (product name of Toa Gosei Chemical Industry Co., Ltd.), "AQUARESERVE GP" (product name of The Nippon Synthetic Chemical Industry Co., Ltd), "SUMIKA-GEL" (product name of Sumitomo Chemical Company, Limited.), "SANWET" (product name of Sanyo Chemical Industry, Ltd.), "ARASORB" (Arakawa Chemical Industries Ltd.), "DRYTECH" (product name of The Dow Chemical Company) and "FAVOR" (product name of Stockhausen Co., Ltd.) and the like. Further, examples of a fiber type of such a material include "BELLOASYS" (product name of Kanebo, Ltd.) and "FIBERSORB" (Camelot Go., Ltd.) and the like.

The use of such a fire-resistant material is particularly effective in the case where the liquid absorbing body is required to have a fire resistant property, such as when the liquid absorbing body is used in an ink jet printer, but in the case where no such a fire resistant property is required, there is no need to use such a fire-resistant material.

As for the thickening material used in the present invention, various know materials can be used. Suitable examples include carboxyl methyl cellulose (CMC), polyvinyl alcohol (PVA), polyacrylic soda and polyethylene oxide (PEO) and the like. These thickening materials are preferred because only a small quantity thereof is required to obtain increased viscosity and they have excellent solubility at normal water temperatures, as well as they are commercially available at a low cost.

In the present invention, the liquid absorbing body includes 30–90 parts by weight of natural cellulose fiber and 10–70 parts by weight a thermally fusible material, and further a thickening material for the amount of 10–50% of the whole of the liquid absorbing body is added. By using thus formed liquid absorbing body, it becomes possible to ensure an absolute liquid absorption volume, while at the same time it is also possible to give a sufficient viscosity for the absorbed liquid. However, the quantity of such materials to be added is not limited to these values. It is possible to add any amount of thickening material to the support fibers so long as thus formed liquid absorbing body can have a sufficient strength and a prescribed viscosity.

Further, it is also preferred that the apparent density of the liquid absorbing body be in the range of 0.08–0.5 g/cc. If the apparent density is below 0.08 g/cc, the spacing will be too large. As a result, it becomes difficult for powdered thickening material and fire-resistant material to be held among the fibers, and thereby the large amount of such material are likely to fall therefrom. Such a liquid absorbing body is unsuitable for commercial products. On the other hand, if the apparent density exceeds 0.5 g/cc, the spacing will be too small, and this leads to an insufficient absolute liquid absorption volume.

Figure 2:
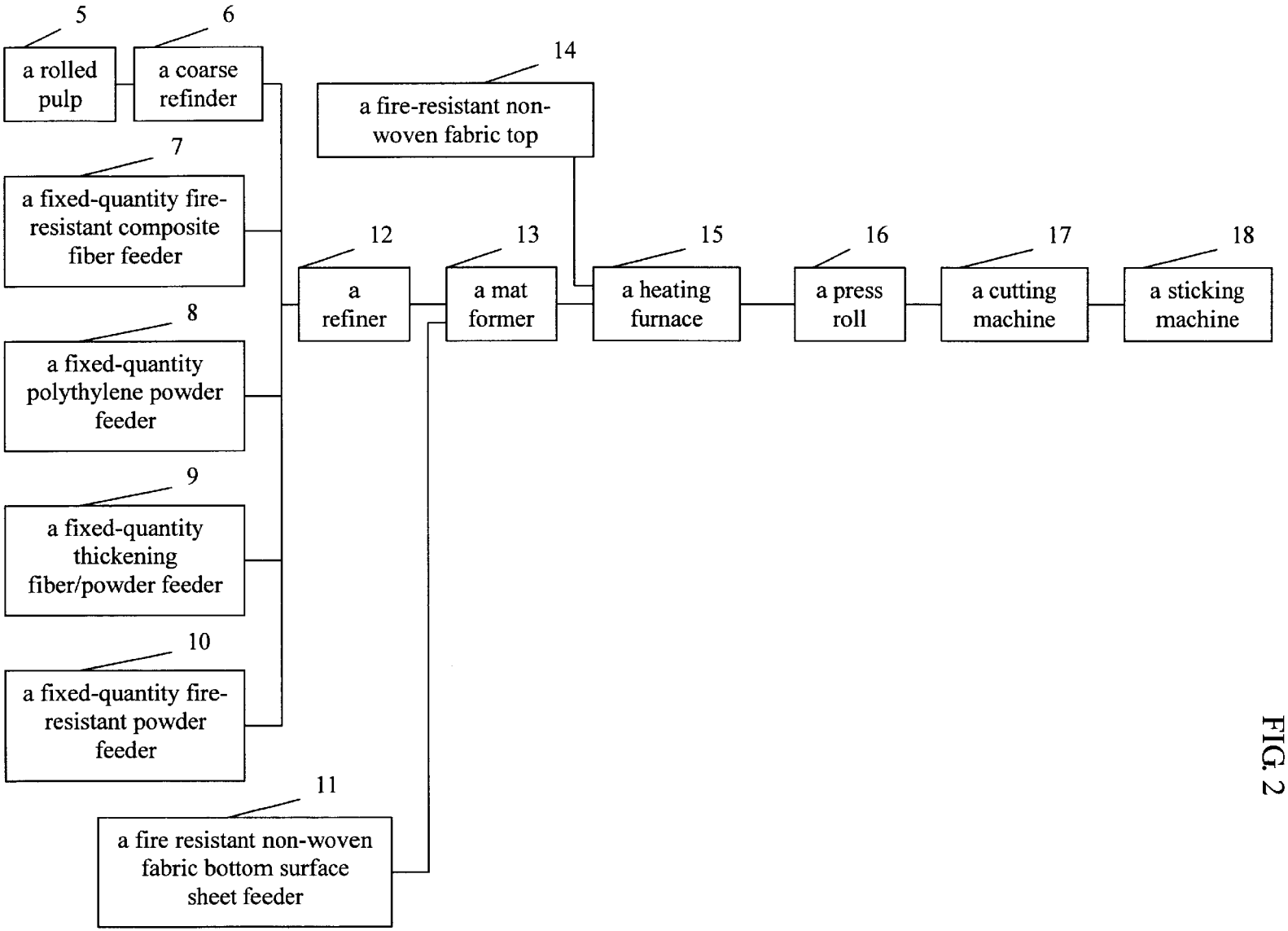
FIG. 2 is an explanatory diagram showing the manufacturing steps for manufacturing a liquid absorbing body according to the present invention.

The method of manufacturing the liquid absorbing body according to the present invention includes the steps shown in FIG. 2. First, natural cellulose fiber supplied from a rolled pulp 5 and pulverized by a coarse refiner 6, a prescribed amount of fire-resistant composite fiber supplied from a fixed-quantity fire-resistant composite fiber feeder 7, a prescribed amount of polyethylene powder supplied from a fixed-quantity polyethylene powder feeder 8, a prescribed amount of thickening fiber/powder supplied from a fixed-quantity thickening fiber/powder feeder 9, and a prescribed amount of fire-resistant powder supplied from a fixed-quantity fire-resistant powder feeder 10 are sent to a refiner 12. In the refiner 12, these materials are defibered and mixed together in air. The mixed materials are then stacked on top of a bottom surface sheet which is supplied from a fire-resistant non-woven fabric bottom surface sheet feeder 11 and put onto a mesh conveyor having a suction box. In this embodiment, the bottom surface sheet and a top surface sheet (which is described hereinbelow) are formed from fire-resistant non-woven fabrics which have an air permeability and have a size of 10–100 g/m$^2$.

Next, the mixed materials stacked on top of the bottom surface sheet are formed into a mat by a mat former 13. Then, after the top surface sheet which is supplied from a fire-resistant non-woven fabric top surface sheet feeder 14 is stacked on the top of the mat, the whole structure is sent to a heating furnace 15. Next, this structure is heated in the heating furnace to a temperature that is above the melting point of the fire-resistant composite fiber and the polyethylene powder. Once the mat reaches a high temperature which causes the fire-resistant composite fiber and the polyethylene powder to melt to exhibit a prescribed viscosity, the mat provided with the bottom and top surface sheets is sent to a press roll 16 and then they are pressed together to form a web. At this point, the thickening fiber/powder and the fire-resistant powder are fixed in the web. Thus obtained web is then cut by a cutting machine 17 into a plurality of pieces each having an appropriate size. Then these pieces are stuck up by a sticking machine 18.

Hereinbelow, the present invention will be described in more details with reference to the Examples.

EXAMPLE 1

In this example, the top and bottom surface sheets were formed from 50 m$^2$ of dry-type pulp non-woven fabric which contains 30 parts by weight of a fire-resistant guanidine-based sulfamic acid. An absorption layer was composed of 1300 g/m$^2$ of coniferous pulp, 600 g/m$^2$ of olefin-based fire-resistant thermally fusible composite fiber (manufactured by CHISSO Corporation under the product name "ESG3 Denier"; length: 5 mm), 50 g/m$^2$ of polyethylene-based powder (manufactured by Ube Industries Ltd. under the product name "UM8420"), 50 g/m$^2$ of carboxyl methyl cellulose (CMC) (manufactured by Daicel Chemical Industries, Ltd. under the product name "CMC Daicel #2200") that is used as the powdered thickening material, and 300 g/m$^2$ of borax (manufactured by US Borax Co., Ltd. under the product name of "BORAX" (10 hydrate borax) that is used as the powdered fire-resistant material. Then, they were defibered (i.e., the fibers are unraveled and separated) in air and then mixed. Thereafter, these materials were placed onto the bottom sheet, and they were sent to a mat former, where a layered mat was formed. Then, the top surface sheet was placed onto the mat (total quantity: 2350 g/m$^2$). Thus formed mat was then guided into a heating furnace, where the mat was heated until it reaches a temperature of 145° C. Thereafter, the mat was removed from the furnace and sent to a press roller. In the press roller, the mat was passed through the press rollers which were heated to a temperature of 160° C. to obtain a liquid absorbing body having a thickness of 16 mm.

EXAMPLE 2

With the exception of using 100 g/m$^2$ of carboxyl methyl cellulose (CMC) (manufactured by Daicel Chemical Industries, Ltd. under the product name "CMC Daicel #2200") as a powdered thickening material, the composition and method of manufacturing the liquid absorbing body of this example are the same as those of Example 1.

EXAMPLE 3

With the exception of using 150 g/m$^2$ of carboxyl methyl cellulose (CMC) (manufactured by Daicel Chemical Industries, Ltd. under the product name "CMC Daicel #2200)" as a powdered thickening material, the composition and method of manufacturing the liquid absorbing body of this example are the same as those of Example 1.

EXAMPLE 4

With the exception of using 50 g/m$^2$ of polyvinyl alcohol (PVA) (manufactured by KURAREY Co., Ltd. under the product name "POBARL 505") as a powdered thickening material, the composition and method of manufacturing the liquid absorbing body of this example are the same as those of Example 1.

EXAMPLE 5

With the exception of using 50 g/m$^2$ of polyacrylic soda (manufactured by Nippon Shokubai Co., Ltd. under the product name "FH-S") as a powdered thickening material, the composition and method of manufacturing the liquid absorbing body of this example are the same as those of Example 1.

EXAMPLE 6

With the exception of using 50 g/m$^2$ of polyethylene oxide (manufactured by Sumitomo Seika Chemicals Company, Limited. under the product name "PEO-18") as a thickening material powder, the composition and method of manufacturing the liquid absorbing body of this example are the same as that of Example 1.

Comparative Example 1

Without using any powdered thickening material and any powdered fire-resistant material, a liquid absorbing body was obtained using the same components and manufacturing method as those used for Example 1.

Comparative Example 2

Without using any powdered thickening material, a liquid absorbing body was obtained using the same components and manufacturing method as those used for Specific Example 1.

For each of these Examples and Comparative Examples, an absorbed liquid holding ability in a vertical state is measured in accordance with the following method. Here, the absorbed liquid holding ability means [an amount of holding absorbed liquid in a vertical state/an amount of holding absorbed liquid in a horizontal state×100%].

INDUSTRIAL UTILIZATION

As described above, the liquid absorbing body according to the present invention is particularly suitable for use in ink jet printers for absorbing waste ink. In particular, the liquid absorbing body according to the present invention can be used for absorbing ink in handy type ink jet printers which have very little internal space in order to achieve compactness. Furthermore, the manufacturing method for manufacturing the liquid absorbing body according to the present invention is suitable for mass producing liquid absorbing bodies which are manufactured in series of processes.

TABLE 1

| | Thickening Material | Amount of Thickening Material ($g/m^2$) | Fire-resistant Material (borax, 300 $g/m^2$) | Absorbed Liquid Holding Ability in Vertical State (g) | Degree of Swelling (%) | Fire Resistance Standard UL94HBF |
|---|---|---|---|---|---|---|
| Example 1 | Carboxyl methyl cellulose (CMC) | 50 | added | 720 | 5 | pass |
| Example 2 | Carboxyl methyl cellulose (CMC) | 100 | added | 750 | 7 | pass |
| Example 3 | Carboxyl methyl cellulose (CMC) | 150 | added | 780 | 9 | pass |
| Example 4 | Polyvinyl alcohol (PVA) | 50 | added | 440 | 4 | pass |
| Example 5 | Polyacrylic soda | 50 | added | 710 | 15 | pass |
| Example 6 | Polyethylene oxide | 50 | added | 680 | 5 | pass |
| Comparative Example 1 | none | 0 | none | 400 | 3 | failure |
| Comparative Example 2 | none | 0 | added | 400 | 3 | pass |

Specifically, in order to measure the liquid holding ability in a vertical state, a sheet-shaped piece having a size of 135.5 mm×370 mm (0.05 $m^2$) was cut out from the liquid absorbing body of each of the Examples and Comparative Examples. Then, the respective sheet-shaped pieces are immersed in water in a container for ten minutes. Next. the sheet-shaped pieces which have absorbed water were suspended such that a diagonal line thereof was held in vertical state. Thereafter, the liquid holding ability in a vertical state of the respective Examples are measured after 90 minutes have elapsed.

In this regard, it should be noted that the swelling before and after water absorption was determined by measuring the thickness using an R5-B Special Upright Dial Gauge.

With regard to the fire resistant property, it was confirmed through a combustion test which was carried out by A-Pec International Co., Ltd in the U.S.A. to know as to whether its fire resistant property can pass the Fire Resistance Standard UL94HBF Flat Test or not.

The results of the tests for the above-mentioned examples and the comparative examples are shown in the attached TABLE 1. As shown in the TABLE 1, all of the liquid absorbing bodies according to the present invention exhibit a sufficient absorbed liquid holding ability, while the swelling is held as lower as possible. Therefore, such liquid absorbing bodies are suitable for use in ink jet printers of portable type and they can absorb waste ink sufficiently. Further, the results also show that the liquid absorbing bodies formed according to the present invention can pass the Fire Resistance Standard of U.S.A.

What is claimed is:

1. A liquid absorbing body for absorbing waste ink, comprising:

a dry formed absorbing body which is in the form of a web mainly formed from fibers;

a water-soluble viscosity increasing material interposed among at least parts of said fibers; and a thermally fusible material for fixing said water-soluble viscosity increasing material to said fibers, wherein said liquid absorbing body has an apparent density of 0.08–0.5 g/cc.

2. The liquid absorbing body as claimed in claim 1, wherein said thermally fusible material comprises thermally fusible fibers.

3. The liquid absorbing body as claimed in claim 2, wherein said thermally fusible material comprises thermally fusible composite fibers.

4. The liquid absorbing body as claimed in claim 1, wherein said thermally fusible material comprises thermally fusible powder.

5. The liquid absorbing body as claimed in claim 4, wherein said thermally fusible powder has a particle size of 70 mesh pass.

6. The liquid absorbing body as claimed in claim 1, wherein said thermally fusible material comprises thermally fusible fibers and thermally fusible powder.

7. The liquid absorbing body as claimed in claim 1, wherein said thermally fusible material is formed of a material selected from the group consisting of polyethylene, ethylene-vinyl acetate, co-polymer polymide, and co-polymer polyester.

8. The liquid absorbing body as claimed in claim 1, wherein said viscosity increasing material is formed of a material selected from the group consisting of carboxyl methyl cellulose (CMC), polyvinyl alcohol (PVA), polyacrylic soda and polyethylene oxide (PEO).

9. A liquid absorbing body for absorbing waste ink, comprising:

a dry formed absorbing body which is in the form of a web mainly formed from fibers;

a water-soluble viscosity increasing material interposed among at least parts of said fibers; and a thermally fusible material for fixing said water-soluble viscosity increasing material to said fibers, wherein said thermally fusible material has a fire-resistant property.

10. A liquid absorbing body for absorbing waste ink, comprising:

a dry formed absorbing body which is in the form of a web mainly formed from fibers;

a water-soluble viscosity increasing material interposed among at least parts of said fibers; and a thermally fusible material for fixing said water-soluble viscosity increasing material to said fibers, wherein the absorbing body is composed of 30–90 parts by weight of natural cellulose fibers, 70–10 parts by weight of the thermally fusible material, to which is added 1–50 wt % of the viscosity increasing material, based on weight of the natural cellulose fibers and the thermally fusible material.

11. A liquid absorbing body for absorbing waste ink, comprising:

a dry formed absorbing body which is in the form of a web mainly formed from fibers;

a water-soluble viscosity increasing material interposed among at least parts of said fibers; and a thermally fusible material for fixing said water-soluble viscosity increasing material to said fibers, wherein said liquid absorbing body has two sides, and a surface sheet is laminated onto one side or onto both sides of said liquid absorbing body, and wherein said surface sheet is formed from a non-woven fiber or paper which has fire-resistant property and air permeability having a size of 10–100 g/m$^2$.

12. A liquid absorbing body for absorbing waste ink, comprising:

a dry formed absorbing body which is in the form of a web mainly formed from fire-resistant fibers;

a water soluble viscosity increasing material interposed among at least parts of said fire-resistant fibers; and a thermally fusible material for fixing said viscosity increasing material to said fibers, wherein said thermally fusible material has a fire-resistant property.

13. A liquid absorbing body for absorbing waste ink, comprising:

a dry formed absorbing body which is in the form of a web mainly formed from fire-resistant fibers;

a water soluble viscosity increasing material interposed among at least parts of said fire-resistant fibers; and a thermally fusible material for fixing said viscosity increasing material to said fibers, wherein said liquid absorbing body has an apparent density of 0.08–0.5 g/cc.

14. The liquid absorbing body as claimed in claim 13, wherein said thermally fusible material comprises thermally fusible fibers.

15. The liquid absorbing body as claimed in claim 14, wherein said thermally fusible material comprises thermally fusible composite fibers.

16. The liquid absorbing body as claimed in claim 13, wherein said thermally fusible material comprises thermally fusible powder.

17. The liquid absorbing body as claimed in claim 16, wherein said thermally fusible powder has a particle size of 70 mesh pass.

18. The liquid absorbing body as claimed in claim 13, wherein said thermally fusible material comprises thermally fusible fibers and thermally fusible powder.

19. The liquid absorbing body as claimed in claim 13, wherein said thermally fusible material is formed of a material selected from the group consisting of polyethylene, ethylene-vinyl acetate, co-polymer polyamide, and co-polymer polyester.

20. The liquid absorbing body as claimed in claim 13, wherein said viscosity increasing material is formed of a material selected from the group consisting of carboxyl methyl cellulose (CMC), polyvinyl alcohol (PVA), polyacrylic soda and polyethylene oxide (PEO).

21. A liquid absorbing body for absorbing waste ink, comprising:

a dry formed absorbing body which is in the form of a web mainly formed from fire-resistant fibers;

a water soluble viscosity increasing material interposed among at least parts of said fire-resistant fibers; and a thermally fusible material for fixing said viscosity increasing material to said fibers, wherein the absorbing body is comprised of 30–90 parts by weight of natural cellulose fibers, 70–10 parts by weight of the thermally fusible material to which is added 1–50 wt % of the viscosity increasing material, based on weight of the natural cellulose fibers and the thermally fusible material.

22. A liquid absorbing body for absorbing waste ink, comprising:

a dry formed absorbing body which is in the form of a web mainly formed from fire-resistant fibers;

a water soluble viscosity increasing material interposed among at least parts of said fire-resistant fibers; and a thermally fusible material for fixing said viscosity increasing material to said fibers, wherein said liquid absorbing body has two sides, and a surface sheet is laminated onto one side or onto both sides of said liquid absorbing body, and wherein said surface sheet is formed from a non-woven fabric or paper which has a fire-resistant property and air permeability having a size of 10–100 g/m$^2$.

23. A liquid absorbing body for absorbing waste ink, comprising:

a dry formed absorbing body which is in the form of a web mainly formed from fibers;

a fire-resistant material and a water soluble viscosity increasing material interposed among at least part of said fibers; and a thermally fusible material for fixing said fire-resistant material and said viscosity increasing material to said fibers, wherein said thermally fusible material has a fire-resistant property.

24. A liquid absorbing body for absorbing waste ink, comprising:

a dry formed absorbing body which is in the form of a web mainly formed from fibers;

a fire-resistant material and a water soluble viscosity increasing material interposed among at least part of said fibers; and a thermally fusible material for fixing said fire-resistant material and said viscosity increasing material to said fibers, wherein said liquid absorbing body has an apparent density of 0.08–0.5 g/cc.

25. The liquid absorbing body as claimed in claim 24, wherein said thermally fusible material comprises thermally fusible fibers.

26. The liquid absorbing body as claimed in claim 25, wherein said thermally fusible material comprises thermally fusible composite fibers.

27. The liquid absorbing body as claimed in claim 24, wherein said thermally fusible material comprises thermally fusible powder.

28. The liquid absorbing body as claimed in claim 27, wherein said thermally fusible powder has a particle size of 70 mesh pass.

29. The liquid absorbing body as claimed in claim 24, wherein said thermally fusible material comprises thermally fusible fibers and thermally fusible powder.

30. The liquid absorbing body as claimed in claim 24, wherein said thermally fusible material is formed of a material selected from the group consisting of polyethylene, ethylene-vinyl acetate, co-polymer polymide, and co-polymer polyester.

31. The liquid absorbing body as claimed in claim 24, wherein said viscosity increasing material is formed of a material selected from the group consisting of carboxyl methyl cellulose (CMC), polyvinyl alcohol (PVA), polyacrylic soda and polyethylene oxide (PEO).

32. A liquid absorbing body for absorbing waste ink, comprising:

a dry formed absorbing body which is in the form of a web mainly formed from fibers:

a fire-resistant material and a water soluble viscosity increasing material interposed among at least part of said fibers; and a thermally fusible material for fixing said fire-resistant material and said viscosity increasing material to said fibers, wherein the absorbing body is comprised of 30–90 parts by weight of natural cellulose fibers, 70–10 parts by weight of the thermally fusible material to which is added 1–50 wt % of the viscosity increasing material, based on weight of the natural cellulose fibers and the thermally fusible material.

33. A liquid absorbing body for absorbing waste ink, comprising:

a dry formed absorbing body which is in the form of a web mainly formed from fibers;

a fire-resistant material and a water soluble viscosity increasing material interposed among at least part of said fibers; and a thermally fusible material for fixing said fire-resistant material and said viscosity increasing material to said fibers, wherein said liquid absorbing body has two sides, and a surface sheet is laminated onto one side or onto both sides of said liquid absorbing body, and wherein said surface sheet is formed from a non-woven fabric or paper which has a fire-resistant property and air permeability and which has a size of 10–100 g/m$^2$.

* * * * *